US010348018B2

(12) United States Patent
Greenway et al.

(10) Patent No.: US 10,348,018 B2
(45) Date of Patent: Jul. 9, 2019

(54) FORK TYPE ELECTRICAL CONNECTOR

(71) Applicant: TRW Limited, Solihull West Midlands (GB)

(72) Inventors: Timothy Bryan Greenway, Warwickshire (GB); David Jonathon Coles, West Midlands (GB)

(73) Assignee: TRW Limited, Solihull, West Midlands (GB)

( * ) Notice: Subject to any disclaimer, the term of this patent is extended or adjusted under 35 U.S.C. 154(b) by 0 days.

(21) Appl. No.: 14/386,448

(22) PCT Filed: Mar. 8, 2013

(86) PCT No.: PCT/GB2013/050587
§ 371 (c)(1),
(2) Date: Sep. 19, 2014

(87) PCT Pub. No.: WO2013/140131
PCT Pub. Date: Sep. 26, 2013

(65) Prior Publication Data

US 2015/0017846 A1 Jan. 15, 2015

(30) Foreign Application Priority Data

Mar. 20, 2012 (GB) ..... 1204866.6

(51) Int. Cl.
*H01R 13/04* (2006.01)
*H01R 9/26* (2006.01)
(Continued)

(52) U.S. Cl.
CPC ..... *H01R 13/04* (2013.01); *H01R 9/2675* (2013.01); *H01R 13/10* (2013.01); *H01R 11/12* (2013.01); *H01R 13/03* (2013.01)

(58) Field of Classification Search
CPC ..... H01R 31/08; H01R 31/085; H01R 11/12
(Continued)

(56) References Cited

U.S. PATENT DOCUMENTS 2,395,145 A * 2/1946 Ranney ..... H01J 5/50
313/318.02
2,613,287 A * 10/1952 Geiger ..... H02B 1/207
200/1 R
(Continued)

FOREIGN PATENT DOCUMENTS

DE 3312002 C1 4/1983
DE 4322535 A1 1/1995
(Continued)

OTHER PUBLICATIONS https://en.wikipedia.org/wiki/Lead_frame, retrieved Apr. 26, 2017.*
(Continued)

*Primary Examiner* — Ross N Gushi
(74) *Attorney, Agent, or Firm* — MacMillan, Sobanski & Todd, LLC

(57) ABSTRACT

A fork type electrical connector for use in providing an electrical joint includes a first connector part having a body that supports two spaced prongs; a second connector part including a conductive element with a first face and a second opposing face and which is shaped so as to define a rail flanked on opposing sides by respective spaces; and a pair of outer legs which extends on opposite sides of the element containing the first face from a respective outer edge of a respective space. In a position of use, the prongs extend through respective spaces in the element with the inner edges engaging the edges of the rail to provide an electrically conductive connection and the outer edge of the prongs engaging the legs to apply a force to the prongs that resists the reaction force generated between the prong and the rail.

18 Claims, 6 Drawing Sheets

(51) Int. Cl.
*H01R 13/10* (2006.01)
*H01R 11/12* (2006.01)
*H01R 13/03* (2006.01)

(58) Field of Classification Search
USPC ..... 439/507, 509, 511, 512, 513, 393, 397, 439/422, 435, 43–50, 721–724
See application file for complete search history.

(56) References Cited

U.S. PATENT DOCUMENTS 3,022,480 A * 2/1962 Tiffany ..... H02B 1/207 174/255
3,345,599 A * 10/1967 Henschen ..... H01R 29/00 29/842
3,582,864 A * 6/1971 Sullivan ..... H01R 31/085 174/72 B
3,670,295 A * 6/1972 Ege ..... H01R 13/115 439/709
4,056,299 A * 11/1977 Paige ..... H01R 4/4818 439/225
4,223,971 A * 9/1980 Dola ..... H01R 4/2433 439/395
4,353,610 A * 10/1982 Deters ..... H01R 31/085 439/510
4,509,813 A * 4/1985 Hesse ..... H01R 12/716 439/347
4,567,654 A * 2/1986 Kloenne ..... H01R 31/085 29/876
4,582,377 A 4/1986 Wilmes
4,628,818 A * 12/1986 Nilsson ..... F42B 3/182 102/202.2
4,954,090 A * 9/1990 Shimochi ..... H01R 9/2458 439/329
5,000,699 A * 3/1991 Nadin ..... H01R 31/08 439/189
5,018,990 A * 5/1991 Sakamoto ..... H01R 13/7197 439/620.09
5,133,673 A * 7/1992 Dijkshoorn ..... H01R 4/2495 439/422
5,322,458 A * 6/1994 Hennemann ..... H01R 4/4845 439/723
5,401,180 A * 3/1995 Muzslay ..... H01R 13/7032 102/202.2
5,428,891 A * 7/1995 Samarov ..... H01R 23/6873 264/135
5,483,737 A * 1/1996 Tran ..... H01R 31/08 29/450
5,645,455 A * 7/1997 Seki ..... H01R 13/405 439/189
5,655,930 A * 8/1997 Dechelette ..... H01R 31/085 439/510
5,788,519 A * 8/1998 Stern ..... H01R 31/085 439/189
6,062,916 A 5/2000 Gladd et al.
6,368,128 B1 * 4/2002 Backer ..... H01R 31/08 439/189
6,626,695 B2 * 9/2003 Enomoto ..... H01R 4/182 439/422
6,869,305 B2 * 3/2005 Enomoto ..... H01R 12/68 439/422
7,008,260 B2 3/2006 Diekmann
7,040,914 B2 * 5/2006 Kuwayama ..... H01R 4/182 439/422
7,168,977 B2 * 1/2007 Reibke ..... H01R 9/2675 439/507
7,476,113 B2 * 1/2009 Tamagawa ..... H01R 12/592 439/189
7,883,362 B2 * 2/2011 Ichio ..... H01R 13/40 439/511
8,128,430 B2 * 3/2012 Diessel ..... H01R 31/085 439/507
8,651,902 B2 * 2/2014 Wu ..... H01R 4/363 439/709
8,979,577 B2 * 3/2015 Wu ..... H01R 13/05 439/507
2002/0115348 A1 8/2002 Fukumori et al.
2005/0037641 A1 2/2005 Chen et al.
2009/0170379 A1 * 7/2009 Allina, Jr. ..... H01R 4/48 439/861
2010/0255730 A1 10/2010 Masuda et al.
2011/0059652 A1 3/2011 Hoyack et al.
2013/0035005 A1 2/2013 Hau et al.
2013/0330956 A1 * 12/2013 Shimizu ..... H01R 13/4223 439/345
2015/0017846 A1 * 1/2015 Greenway ..... H01R 9/2675 439/891

FOREIGN PATENT DOCUMENTS

DE 4400469 A1 7/1995
DE 20317158 U1 11/2003
DE 10255674 A1 6/2004
DE 102009047763 A1 6/2011
FR 2626719 A1 8/1989
GB 1269654 4/1972
GB 2084813 A 4/1982
JP H03102781 A 4/1991
JP H08130011 A 5/1996

OTHER PUBLICATIONS

WO2013/140131 International Search Report, dated Apr. 18, 2013.
WO20131140131 Written Opinion of the International Searching Authority, dated Sep. 23, 2014.
DE4322535 English Abstract from espacenet.com.
DE4400469 English Abstract from espacenet.com.
DE10255674 English Abstract from espacenet.com.
FR2626719 English Abstract from espacenet.com.
Great Britain Examination Report, Application No. GB 1416535.1, dated Sep. 12, 2016.

* cited by examiner

FORK TYPE ELECTRICAL CONNECTOR

CROSS-REFERENCE TO RELATED APPLICATIONS

This application is the National Phase of International Application PCT/GB2013/050587 filed Mar. 8, 2013, which designated the U.S. That International Application was published in English under PCT Article 21(2) on Sep. 26, 2013 as International Publication Number WO 2013/140131A1. PCT/GB2013/050587 claims priority to U.K. Application No. 1204866.6 filed Mar. 20, 2012. Thus, the subject nonprovisional application also claims priority to U.K. Application No. 1204866.6 filed Mar. 20, 2012. The disclosures of both applications are incorporated herein by reference.

This invention relates to an electrical connector for use in providing a permanent electrical joint between two parts of an electrical circuit, and in particular to a type of permanent or semi-permanent joint that may be formed using a connector known as "fork connector," the joint comprising a first part having a pair of prongs shaped like a tuning fork and a second part having an elongate conductive rail that is straddled by the prongs of the first part such that during assembly the two parts are physically forced to create an interference fit between the parts.

By permanent or semi-permanent joint we mean that the connection is not intended to be separated during the life of the joint, although, of course, it will be understood that like most things which are made up of multiple parts, it could be separated if required by application of sufficient physical force.

A known fork type connector is shown in FIG. 1. As can be seen, a conductive rail 14 of a second part 11 engages with an interference or force fit between two prongs 15,16 of a first connector part 10. The rail 14 is formed by cutting or stamping two spaced apart rectangular spaces 12,13 in a flat conductive strip or plate of material supported in an insulated housing (not shown). The edges of the spaces 12,13 defining the side of the rail 14 are square cut and, as such, the rail 14, which is the remaining part of the plate between the spaces 12,13, also has square cut edges. Insertion of the prongs 15,16 into the spaces 12,13 causes them to straddle the rail 14 and, during connection causes the prongs 15,16 and rail 14 to smear across one another resulting in an interference type fit between the two parts. This smearing is significant because it ensures that the top layer of the contact surfaces, which may be oxidised or covered in other contaminants, is pushed aside, ensuring a reliable connection between the relatively cleaner underlying surfaces of the two parts. Removal of surface contaminants, especially oxides, also reduces the contact resistance, minimising heating of the joint by the current that flows across it. This helps the joint withstand changes in temperature without degradation.

According to a first aspect the invention provides a fork type electrical connector for use in providing an electrical joint between two parts of an electrical circuit comprising:

a first connector part having a body that supports two spaced prongs that are electrically conductive;

a second connector part comprising a conductive element with a first face and a second opposing face and which is shaped so as to define an electrically conductive rail which is flanked on opposing sides by respective spaces, the width of each space measured from an inner edge of the space defined by the rail to an opposing, outer edge, of the space being less than the width of at least one of the prongs of the first connector part to ensure an interference fit of the prong when located in the space;

and characterised in that a pair of outer legs are provided, each of which extends on a side of the element containing the first face from a respective outer edge of a respective space;

and whereby in a position of use with the first and second connectors connected the prongs extend through respective spaces in the element with the inner edges of the prongs engaging the edges of the rail to provide an electrically conductive connection and the outer edge of the prongs engaging the legs, such that the legs apply a force to the prongs that resists the reaction force generated between the prong and the rail.

The prongs may be of the same material as the rail, preferably a low yield strength material such as a "soft" metal like copper or an alloy of copper. The provision of the outer legs to resist the contact forces makes such a material suitable for use in this joint for application where it may not have been suitable when the joint was constructed according to the prior art.

The prongs may perhaps be plated with a conductive coating.

In one arrangement the first connector part forming the prongs may be formed as a laminate of different layers of material, using one or many different materials.

The outer legs may extend along the full length of the edge of the opening, having the same length as the rail.

The outer legs may be electrically conductive, so that the contact with the prong provides an additional electrical contact and path across the joint.

The legs may be linked to the edge of the space through a curved linking section which encourages smearing of the material of the prongs or legs as the connection is made.

In addition to the two outer legs, the second connector part may include a pair of inner legs which extend away from the first face and are connected to the edges of the conductive rail.

In a position of use with the connector connected, the prongs may form an interference fit with the face of the inner legs of the rail, or with the outer legs, or with both the inner and outer legs. This interference fit helps expose a clean surface free of surface contaminants and oxidation which forms the electrical contact across which current flows through the joint.

The rail and inner legs may together define a rail with a U shape in cross section.

The first connector part may comprise in addition at least a portion which comprises a material that has a different coefficient of expansion to the conductive prongs and arranged such that as the temperature of the connector part increases, at least portions of the inside edges of the prongs are pushed closer together. The first connector part therefore deforms in the manner of a bi-metallic strip, and this helps ensure the connection is maintained with a good force as temperature increases.

A second function of the overmolding is that it may help address a problem that the applicant has indentified in the prior art joints caused by the material creeping over time. The applicant has noted that a conductive material such as copper can creep over time, relaxing its grip on the rail at high temperatures. This can be ameliorated by the use of the portion with a different coefficient of expansion, and which is expected to remain elastic within the temperature environment which the part is exposed to. It should be chosen so that it has a heat deflection temperature above the maximum storage or operating temperature of the joint, for instance 100 degrees centrigrade or perhaps 150 degrees centigrade.

At least a part of the body and a part of the prongs of the first part may be surrounded by a close fitting sleeve which has a higher coefficient of expansion than the body and prongs, the body and prongs and the sleeve being so constructed and arranged that heating of the first connector part causes at least part of the inner edges of the prongs to tend to move together slightly.

The applicant has appreciated that the stability of the overmolding at elevated temperatures may help to mitigate the effects of creep in the prong and rail material. This can be used to provide a more reliable joint, or may advantageously be used to enable a wider range of materials to be employed for any given joint.

The conductive prongs may be keyed to the sleeve using one or more interlocking features to prevent relative movement.

The close fitting sleeve may comprise an overmolding of the body and prongs. It may comprise a reinforced plastic or similar material.

In use the overmolding urges the prongs together which helps maintain the clamping force of the prongs onto the conductive rail.

The outer edge of each prong, or of any overmolding that is provided, may be provided with a crush structure, that may extend along all or a part of a length of the prong, of increasing cross section towards its root, such as a v-shaped or u-shaped ridge, with the peak of the v or U facing away from the prong, whereby when connected the crush feature of a prong presses against a respective outer leg of the second connector part. The crush structure may be adapted to collapse in a controlled manner as the prongs are inserted the force required to achieve a given amount of collapse increasing the more that the structure has collapsed due to its increasing cross section.

The crush feature may comprise a molded plastic material.

The provision of a crush feature helps ensure a consistent force within the connector which helps ensure a good electrical connection regardless of variations in the width of the spaces and width of the prongs that may arise during manufacture due to tolerances.

The first connector part may comprise a part of an electrical lead frame. The second connector part may also comprise a part of a lead frame. One of the lead frames may be an integral part of an electric pump or electric motor or other electrical device.

In a first aspect of the invention, the first connector part may comprise multiple pairs of prongs, each pair straddling a rail of the second part with an interference fit. At least one of the prongs may be urged into contact with the rail by a pair of outer legs of the second part, and preferably all of the prongs may be urged into contact by outer legs.

In use, the first part is connected to one part of an electrical circuit, and the second part is connected to another, the connector providing a joint through which current can flow between the two parts of the electrical circuit.

According to a second aspect the invention provides a first connector part which may be pressed into engagement with a second connector part to provide a permanent electrical joint according to the first aspect of the invention.

According to a third aspect the invention provides a second connector part which may be pressed into engagement with a first connector part to provide a permanent electrical joint according to the first aspect of the invention.

There will now be described by way of example only several embodiments of the present invention with reference to and as illustrated in the accompanying drawings of which:

Figure 2A:
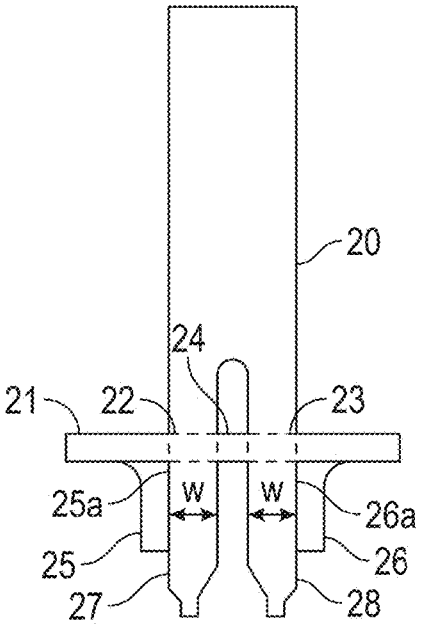
FIG. 2(*a*) is a view in section 2(*b*) is a view from above and 2(*c*) is an isometric view of a first embodiment of a connector assembly in accordance with the present invention.
Figure 2B:
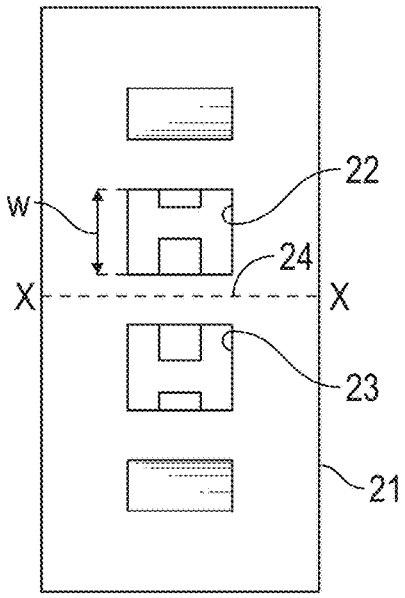
Figure 2C:
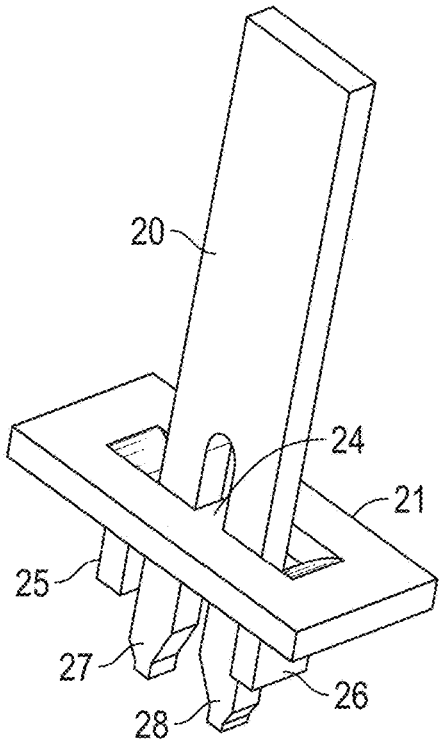

As shown in FIGS. 2(*a*) to (*c*) a first embodiment of a tuning fork type connector assembly comprises a first connector part 20 and a second connector part 21. The first part 20 and the second part 21 can engage one another as shown in the figures to form an electrical connection where current can flow from one part to the other.

The first connector part 20 comprises a body and two prongs 27,28 which extend from the body. The prongs 27,28 are identical in this example, being a mirror image of each other and located on either side of a plane which passes through a middle line of the body. The body and prongs 27,28 are electrically conductive, typically a low yield strength metal which exhibits a degree of creep over time, perhaps copper or an alloy predominantly of copper. The body and prongs 27,28 in this example all lie in a common plane and may be made, for example, by stamping or pressing or otherwise forming from a sheet.

The second connector part 21 comprises a conductive rail 24. The rail 24 is part of a strip or plate of low yield strength material, such as copper or an alloy predominantly of copper. The strip has a first face and an opposing second face and two spaces or through holes 22, 23 formed within it, which extend from the first face through to the second face and which are located side by side. The spaces 22, 23 are marked by dashed lines in FIG. 2(*a*). Where the second connector part 21 comprises a strip, the spaces 22, 23 may be arranged in series along the long axis of the strip, the part of the strip between the spaces 22, 23 defining the elongate conductive rail 24. The rail 24 has a width that is very slightly greater than the spacing between the prongs 27,28 of the first connector part 20 prior to connection to the second connector part 21. As shown in FIG. 2(*b*), the width of each space W, measured perpendicular to the long axis of the rail X-X strip, is slightly smaller than the width w of each prong 27,28 extending therethrough.

Connected to the edge of each space 22, 23 furthest from the rail 24 is a respective outer leg 25,26 which extends generally orthogonally away from the face of the strip, i.e., at right angles to the plane containing the strip. The two outer legs 25,26 extend from the same face of the strip and are electrically conductive. Indeed, they are an integral part of the strip. The regions 25*a*, 26*a* where the legs 25,26 join the face of the strip are curved so that there is a smooth transition from a face of the strip that is on the opposite side to the legs along to a face of the legs. As will become apparent, this helps achieve smearing of the surface material when the electrical connector is assembled into a permanent joint. The radius of this curve is not critical, and for this example is around 5 to 10 percent of the width of each space. Because of this curve, the outer legs 25,26 may be considered to extend slightly into the space directly below the space, assuming the strip is held with the outer legs 25,26 extending down and the edge of the space being the region where the strip transitions into the curve. In fact, the width of the spaces 22, 23 and location of the outer legs 25,26 are such that the prongs 27,28 of the first connector part 20 cannot pass through the spaces 22, 23 without deformation of the first connector part 20 or the second connector part 21.

In use, the first connector part 20 is aligned with the second connector part 21 with the prongs 27,28 facing the spaces 22,23 and on the opposite side of the conductive rail 24 of the second connector part to the outer legs 25,26. The prongs 27,28 are then pressed through the respective spaces 22,23, which causes the inner edges of the prongs 27,28 (i.e., those edges of the prongs 27,28 that face one another) to cut and or smear the edges of the conductive rail 24. This connecting action causes some smearing of the outer edges of the prongs 27,28 and the outer legs 25.26, splaying the outer legs 25,26 outwards slightly away from each other. The outer legs 25,26 oppose this, applying an inward force to the prongs 27,28 to push them onto the conductive rail 24.

With the first and second connector parts 20, 21 fully engaged, there is a good contact between the two parts which provides a good electrical connection. The legs help press the prongs onto the conductive rail and provide additional contact surface contact force to help resist creep.

Figure 3A:
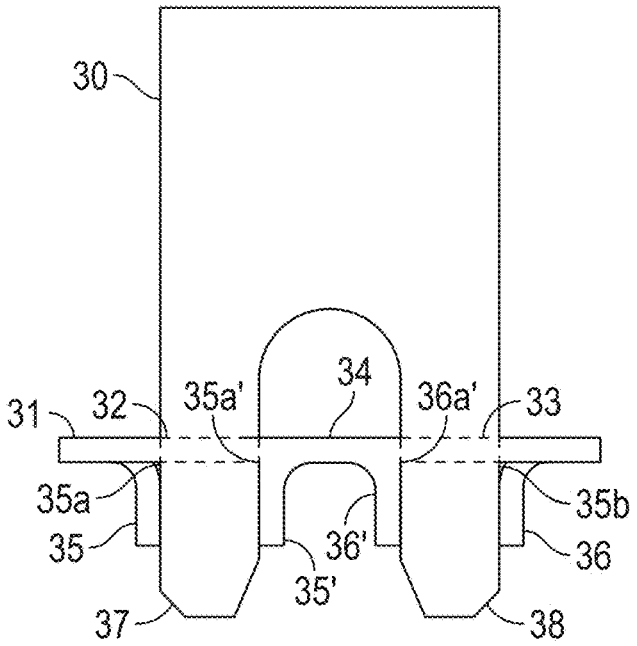
FIG. 3(*a*) is a view in section and 3(*b*) is an isometric view of a second embodiment of a connector assembly according to the present invention.
Figure 3B:
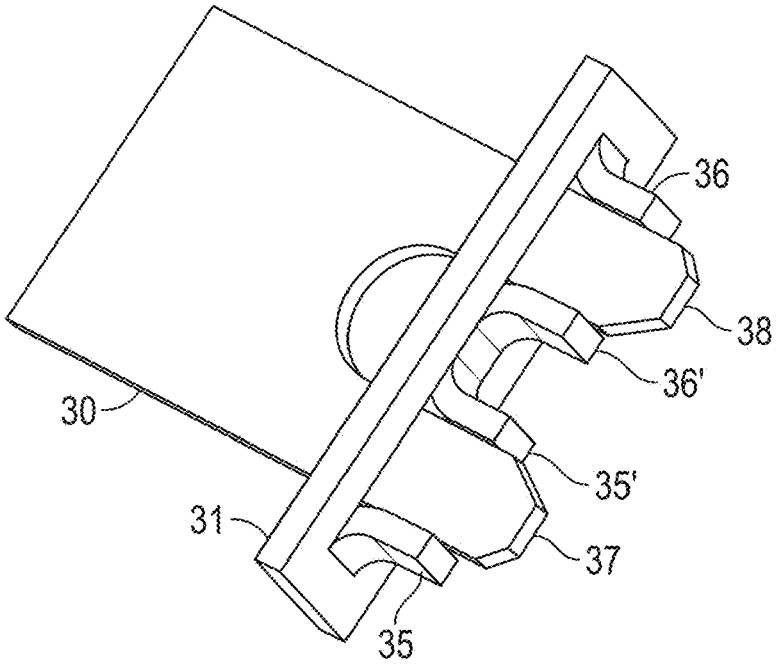

A second embodiment is shown in FIGS. 3(*a*) and (*b*) of the drawings. This is generally the same as the first embodiment with many common features.

The first connector part 30 is identical to that of the first embodiment and comprises a body and two prongs 37,38 which extend from the body. The prongs 37,38 in this example are slightly wider spaced than those of the first to accommodate a relatively wider rail as will be described.

The second connector part 31 is similar to that of the first embodiment and comprises a flat strip or plate with two spaces 32,33 which are separated by a conductive rail 34. Connected to the edge of each space 32,33 furthest from the rail 34 is a respective outer leg 35,36 which extends generally orthogonally away from the strip. The regions 35*a*, 35*b* where each of the outer legs 35,36 joins the strip is curved so that there is a smooth transition from a face of the strip that is on the opposite side to the legs along on to a face of the outer legs 35,36.

The second embodiment differs from the first embodiment in that two further inner legs 35', 36' are provided, each one extending away from a respective edge of the conductive rail 34 that defines an edge of a respective space 32,33. These additional inner legs 35',36' extend along the full length of the conductive rail 34 such that the rail 34 can be considered to have a shape such as a U shape when viewed in cross section. The inner pair of legs 35',36' are connected by a smooth curved portion to the rail 34 and are electrically conductive like the outer pair of legs 35,36. All four of the legs 35,35',36,36' are on the same side of the strip or plate.

In use, the first connector part 30 is secured to the second connector part 31 by pressing the prongs 37,38 through the spaces 32,33 so that they straddle the U shaped rail 34. The prongs 37,38 cut into the surfaces of the inner and outer legs 35,35',36,36', splaying the outer legs 35,36 away from one another and pressing the inner legs 35',36' toward each other. This provides a good contact between the prongs 37,38 and the conductive legs 35,35',36,36'. The curved edges to the legs 35,35',36,36' also promotes smearing of the material at the joint, in addition to a cutting action. The U shaped rail is more physically robust than the prior art design, which uses a thin flat rail, and this facilitates higher insertion forces, contact pressure, and consequently lower electrical contact resistance.

Figure 4A:
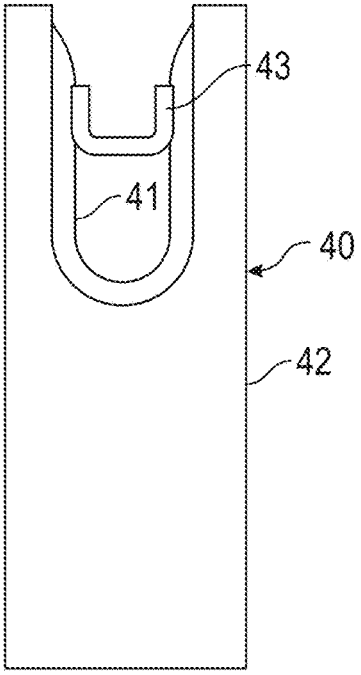
FIG. 4(*a*) is section view, 4(*c*) is an isometric view and, 4(*b*) a cross section view of a first connector part and a portion of a second connector part of a third embodiment of a connector assembly according to the present invention.
Figure 4C:
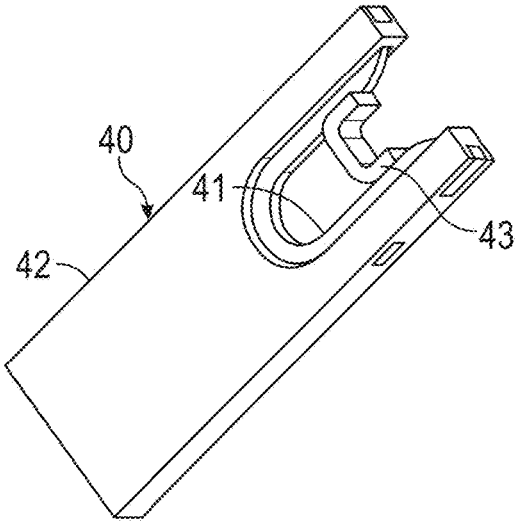
Figure 4B:
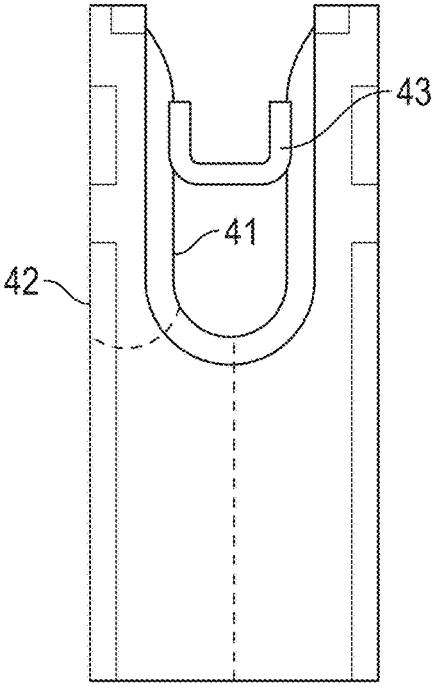

A third embodiment of the invention is shown in FIGS. 4 (*a*) to (*c*) of the drawings.

Figure 1:
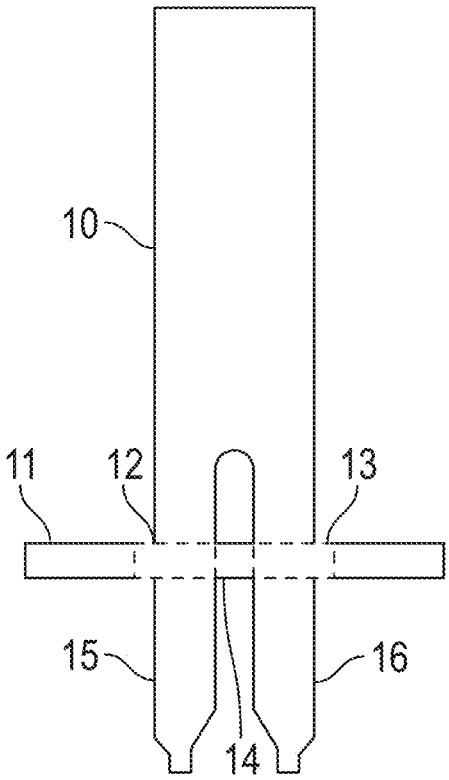
FIG. 1 (PRIOR ART)
FIG. 1 is a representation of a prior art electrical joint.

In this embodiment, the first connector part 40 again comprises a body and prongs 41 of conductive copper or copper alloy material. The body and prongs 41 are overmolded with a reinforced plastic material 42, such as glass filled PBT or a similar material, part of the overmolding being cut-away around the inner edges of the prongs 41 to expose the conductive material. The second connector part comprises an elongate rail 43 of U-shaped cross section, although it may have the same section as the rail shown in FIGS. 1 and 2, that fits between the prongs 41. The degree to which the overmolding is cut away may partly be to recognise tooling considerations, and the inner edges are the only bits that need to be exposed.

In use, the prongs 41 straddle the U-shaped rail 43 to give a good electrical contact between the rail 43 and the prongs 41. An advantage of this embodiment over one which does not have an overmolding comes to light when the temperature of the connection increases. By choosing an overmolding material that has a higher coefficient of expansion that the copper or copper alloy, and making it sufficiently rigid relative to the prongs 41, the edges of the prongs 41 that contact the rail 43 can be urged towards the rail 43 as the temperature increases, thus increasing the security of the electrical connection by restraining outward expansion of the prongs 41. The applicant has noted that the stability of the overmolding at elevated temperatures may help mitigate the effects of creep in the material of the prongs 41 and/or the rail 43.

Figure 5A:
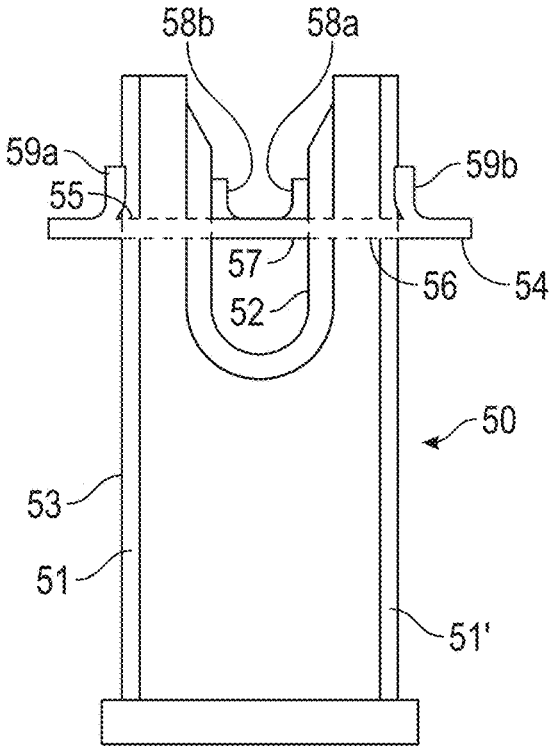
FIG. 5(*a*) is a cross section view and (*b*) a perspective view of a fourth embodiment of an electrical connector according to the present invention.
Figure 5B:
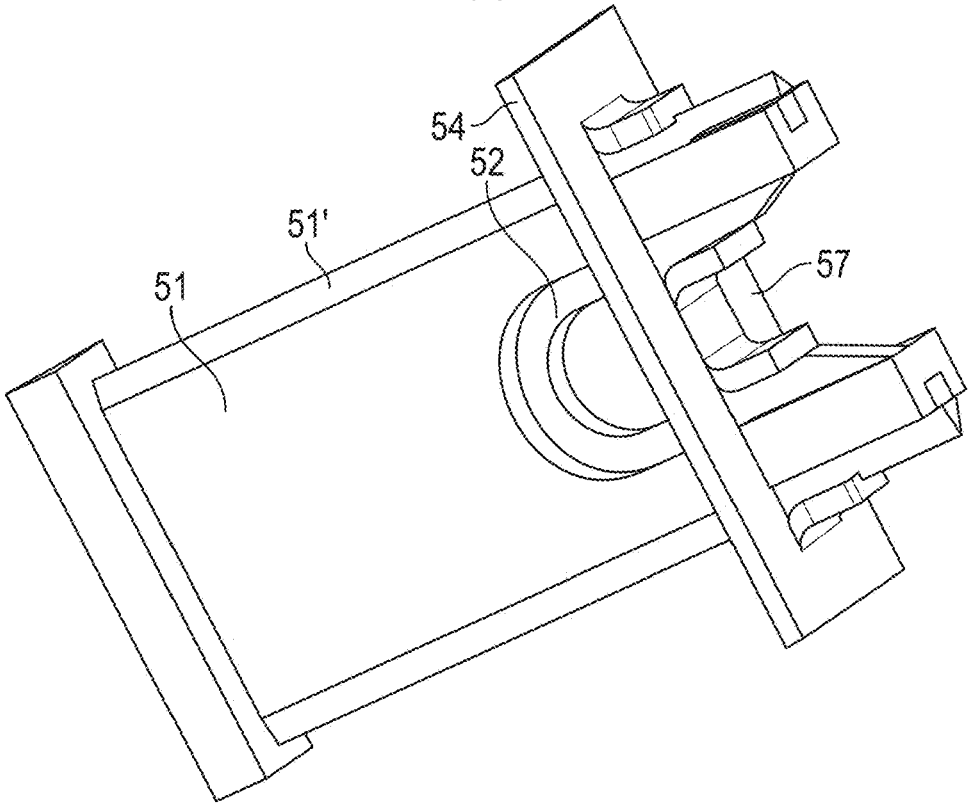

A fourth embodiment is shown in FIGS. 5(*a*) and (*b*). This combines features from the second and third embodiments.

The first connector part 50 comprises a conductive copper or copper alloy body and prongs 52 and is overmolded with a rigid plastic reinforced material 51. Along the outer edges of each prong 52 is a raised ridge 51' of relatively rigid plastic having a crush feature of increasing cross section toward its root, such as a V-shaped cross section, the peak of the V-shaped ridge 51' facing away from the prongs 52. The overmolding is shaped so that the copper or copper alloy material is exposed along an inner edge of each prong 52.

A second connecting part 54 is provided which is similar to that of the second embodiment, with two spaces 55,56 having a U-shaped rail 57 with inner legs 58*a* and 58*b* and outer legs 59*a*, 59*b*. The spacing between the legs 58*a*,58*b*, 59*a*,59*b* prior to connecting to the first connecting part is less than the width of a prong 52 plus the overmolding including the V-shaped ridge 51'.

During connection, the prongs 52 are pushed into the spaces 55,56, and the inner edges of the prongs 52 cut into the sides of the U-shaped rail 57. Some smearing of the material occurs due to the curved interface of the inner legs 58*a*, 58*b* and upper face of the rail 57. The V-shaped ridges 51' press against and deform the outer legs 59*a*, 59*b* and acts as a crush feature to control the force applied by the inner edges of the prongs 52 on the U-shaped rail 57. This helps ensure contact pressure despite variations in the size of the spaces, and width of the prongs that may occur due to manufacturing tolerances.

In use, any increase in temperature will see the metal prongs 52 moving inwardly slightly toward each other to press further against the U-shaped rail 57 as they are constrained by the plastic overmolding. This increases the security of the connection. The V-shaped ridges 51' on the outer edges of the prongs 52 function as crush structures, collapsing as the prongs 52 are inserted. This helps control the forces exerted by the inner edges of the prongs 52 onto the U-shaped rail 57.

Figure 6:
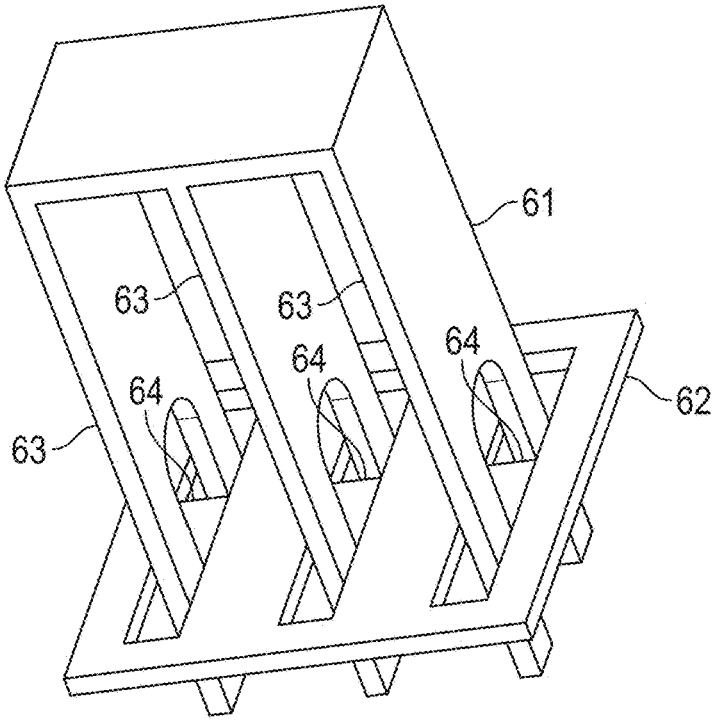
FIG. 6 is an isometric view of a still further electrical connector within the scope of the present invention.
Figure 7:
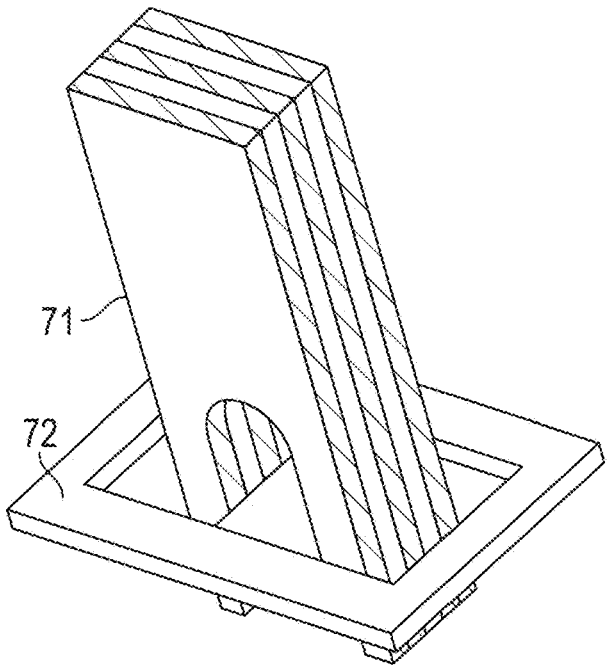
FIG. 7 is an isometric view of another electrical connector within the scope of the present invention.

Various modifications can be made within the scope of the present invention. FIG. 6 illustrates how a connector can be provided which has a first connector part 61 and a second connector part 62 including a rail, the first part including multiple prongs 63 connected in series to respective rails 64. This arrangement provides multiple pathways for current to flow across the completed joint, giving an increased number of regions of contact, and hence reducing the flux and potential for self heating of the joint.

In a still further alternative a first connector part 71 and a second connector part 72 may be provided in which the prong may be formed as a laminate of several sheets of material, perhaps with differing physical properties.

The multiple prongs/rails and laminated prongs can of course be incorporated into the embodiments shown in FIGS. 2 to 5 if desired.

The invention claimed is:

1. A fork type electrical connector assembly comprising:

a first connector part including a body and two spaced prongs of unitary construction with the body, the first connector part being electrically conductive; and a second connector part including a conductive element having a first face and a second opposing face, the second connector part being shaped so as to define an electrically conductive rail; wherein the second connector part also includes a pair of outer legs that respectively are positioned on the second face on each side of the rail, extend away from the first face, and bias the prongs of the first connector part toward the rail, and the rail and pair of outer legs of the second connector part are positioned so as to induce an interference fit between the first connector part and second connector part, and wherein either:

(1) the first connector part includes at least a portion which includes a material that has a different coefficient of expansion than the prongs and are arranged such that as the temperature of the connector part increases, at least a portion of the inside edges of the prongs are pushed together, (2) at least a part of the body and a part of the prongs of the first part are surrounded by a close fitting sleeve which has a higher coefficient of expansion than the body and prongs, the body and prongs and the sleeve being constructed and arranged such that heating of the first connector part causes at least part of the inner edges of the prongs to move together, or (3) the outer edge of each prong is provided with a crush structure that extends along all or a part of a length of the prong, of increasing cross section towards its root, whereby when connected the crush feature of a prong presses against a respective outer leg of the second connector part.

2. The fork type electrical connector assembly defined in claim 1 wherein the prongs are formed from the same material as the rail.

3. The fork type electrical connector assembly defined in claim 1 wherein the prongs are plated with a conductive coating.

4. The fork type electrical connector assembly defined in claim 1 wherein the first connector part forming the prongs is formed as a laminate of different layers of materials.

5. The fork type electrical connector assembly defined in claim 1 wherein each of the pair of outer legs extends along a full length of an edge of an opening formed through the second connector part having the same length as the rail.

6. The fork type electrical connector assembly defined in claim 1 wherein each of the pair of outer legs is electrically conductive.

7. The fork type electrical connector assembly defined in claim 1 wherein each of the pair of outer legs is linked to an edge of a space through a curved linking section.

8. The fork type electrical connector assembly defined in claim 1 wherein the second connector part includes a pair of inner legs which extend away from the first face and are connected to the edges of the rail.

9. The fork type electrical connector assembly defined in claim 8 wherein the prongs form an interference fit with the inner legs, or with the outer legs, or with both the inner legs and the outer legs.

10. The fork type electrical connector assembly defined in claim 8 wherein the rail and inner legs are generally U-shaped in cross section.

11. The fork type electrical connector assembly defined in claim 1 wherein the first connector part includes at least a portion which includes a material that has a different coefficient of expansion than the prongs and are arranged such that as the temperature of the connector part increases, at least a portion of the inside edges of the prongs are pushed together.

12. The fork type electrical connector assembly defined in claim 1 wherein at least a part of the body and a part of the prongs of the first part are surrounded by a close fitting sleeve which has a higher coefficient of expansion than the body and prongs, the body and prongs and the sleeve being constructed and arranged such that heating of the first connector part causes at least part of the inner edges of the prongs to move together.

13. The fork type electrical connector assembly defined in claim 12 wherein the conductive prongs are keyed to the sleeve using one or more interlocking features to prevent relative movement.

14. The fork type electrical connector assembly defined in claim 12 in which the close fitting sleeve includes an overmolding of the body and prongs.

15. The fork type electrical connector assembly defined in claim 1 in which the outer edge of each prong is provided with a crush structure that extends along all or a part of a length of the prong, of increasing cross section towards its root, whereby when connected the crush feature of a prong presses against a respective outer leg of the second connector part.

16. The fork type electrical connector assembly defined in claim 1 in which the first connector part includes a part of an electric pump or electric motor or other electrical device.

17. The fork type electrical connector assembly defined in claim 1 in which the first connector part includes multiple pairs of prongs, each pair straddling a rail of the second part with an interference fit.

18. A fork type electrical connector assembly comprising:

a first connector part formed from an electrically conductive material and including a body having first and second prongs extending therefrom; and a second connector part formed from an electrically conductive material and including a first face, a second face, and first and second openings that extend through second connector part from the first face to the second face, wherein:

(1) the first and second openings have respective first and second inner edges that define a rail portion of the second connector extending therebetween;

(2) the first and second openings have respective first and second outer edges that are respectively opposed to the first and second inner edges;

(3) the second face of the second connector part being planar except for first and second outer legs that respectively extend from adjacent the first and second outer edges of the second face of the second connector part;

(4) the first and second prongs of the first connector part respectively extend through the first and second openings of the second connector part so as to provide an interference fit between the first connector part and the second connector part; and (5) the first and second outer legs of the second connector part respectively engage the first and second prongs of the first connector part to bias the first and second prongs of the first connector part into engagement with first and second inner edges of the respective first and second openings that define the rail portion of the second connector part.

* * * * *